US005146963A

United States Patent [19]

Carpenter et al.

[11] Patent Number: 5,146,963

[45] Date of Patent: Sep. 15, 1992

[54] CHIPPING DEVICE

[75] Inventors: Charles T. Carpenter; Robert M. Bayly, both of Lake Oswego, Oreg.

[73] Assignee: Commercial Knife, Inc., Wilsonville, Oreg.

[21] Appl. No.: 787,253

[22] Filed: Nov. 4, 1991

[51] Int. Cl.[5] ..... B26D 1/12; B27G 13/00

[52] U.S. Cl. ..... 144/231; 144/229; 144/230; 144/241; 467/5; 467/41; 467/46

[58] Field of Search ..... 407/5, 6, 31, 41, 46, 407/49; 144/162, 176, 218, 229, 230, 231, 236, 241

[56] References Cited

U.S. PATENT DOCUMENTS

| | | | |
|---|---|---|---|
| 867,980 | 10/1907 | Krieger | 83/842 |
| 3,356,114 | 12/1967 | Noel | 144/230 |
| 3,487,865 | 1/1970 | Chapman et al. | 144/237 |
| 4,151,869 | 5/1979 | Halloran et al. | 407/46 |
| 4,667,713 | 5/1987 | Wright | 144/231 |
| 4,889,025 | 12/1989 | Collett | 144/241 |

*Primary Examiner*—W. Donald Bray

*Attorney, Agent, or Firm*—Kolisch, Hartwell, Dickinson

[57] ABSTRACT

A chipping cutter head having multiple spindle segments disposed side-by-side and forming a body in the cutter head. Circumferentially distributed pockets in each spindle segment have knife holders detachably mounted therein and held in place by clamps. Double-edged knife elements, that are replaceable, are detachably clamped in position on each knife holder.

8 Claims, 4 Drawing Sheets

CHIPPING DEVICE

BACKGROUND AND SUMMARY OF THE INVENTION

This invention relates to a chipping cutter head, sometimes referred to as a chipping canter, which is usable to remove, in the form of chips, material cut from a body such as a log to produce a cant from the log. Ordinarily, such a cutter head is rotatable about an axis provided by shaft extensions extending from opposite ends of a body in the cutter head, and has a plurality of cutting elements distributed about the circumference of the cutter head body which cuts chips in a planing-type action from the wood material processed.

A conventional chipping cutter head, as presently known, includes a cutter head body with cavities distributed about the circumference of the body. Knife bodies are detachably mounted within these cavities, and the knife bodies are provided with sharp knife edges movable in circumferential sweeps to produce the cutting action. Periodically, these knife bodies must be sharpened, and this is done by removing and then sharpening a knife body, with the knife body afterwards being returned to the cavity which mounted it. In order that the knife bodies be properly mounted, with their cutting edges exactly positioned to produce the desired cutting action, a mounting for each body of suitable babbitt material is provided, between the knife body and floor of the cavity which receives it. The babbitt material is effective to support the knife body at the exact desired position. Obviously, however, with a great many knife bodies collectively producing the cutting action provided in a cutter head, periodic sharpening, followed with proper mounting of the knife bodies, is time consuming, and, furthermore, requires skill and experience in the personnel performing the work.

An object of this invention is to provide an improved chipping cutter head, which features replaceable knife elements with a pair of cutting edges provided along opposite respective margins. A cutting element is precision made, and is returned or recycled after dulling of its edges. The knife element is detachably mounted against a knife holder, and the knife holder is detachably mounted within a suitable cavity or pocket in the body of the cutter head.

When a new cutting edge is desired, the knife element is either turned to substitute an unused edge for the edge that has been dulled or, if both edges have been used, replaced by a new knife element. In either case, no grinding is required by the user, and no babbitting or other positioning is required of the knife holder, since the position of the knife holder, once properly established, is always maintained.

A further feature and object of the invention is the provision, in the chipping cutter head, of a novel organization of guiding surfaces provided in a clamp which holds a knife holder in place and in the knife holder itself. The guiding surfaces collectively provide a ramp for chip material cut with operation of the cutter head. The path provided by this ramp is readily changed to conform to that desired for the particular species of wood being handled. In this connection, it should be remembered that with a more sharply curved concave path leading from the cutting edge, chip material cut from the wood tends to have a thinner chip consistency than when the concavity of this guiding surface extends with a more gradual concave curvature. Additionally, a curvature which may be effective to produce desired chip thickness with one species of wood may be different from the curvature producing proper chip thickness with a different wood species.

Another object of the invention is to provide a chipping cutter head which has a replaceable knife held on a knife mounting, and means locking the knife from shifting along its axis (or parallel to a cutting edge) relative to a knife holder in the cutter head.

BRIEF DESCRIPTION OF THE DRAWINGS

These and other objects and advantages are attained by the invention, which is described herein below in conjunction with the accompanying drawings, wherein.

DETAILED DESCRIPTION OF A PREFERRED EMBODIMENT

Figure 1:
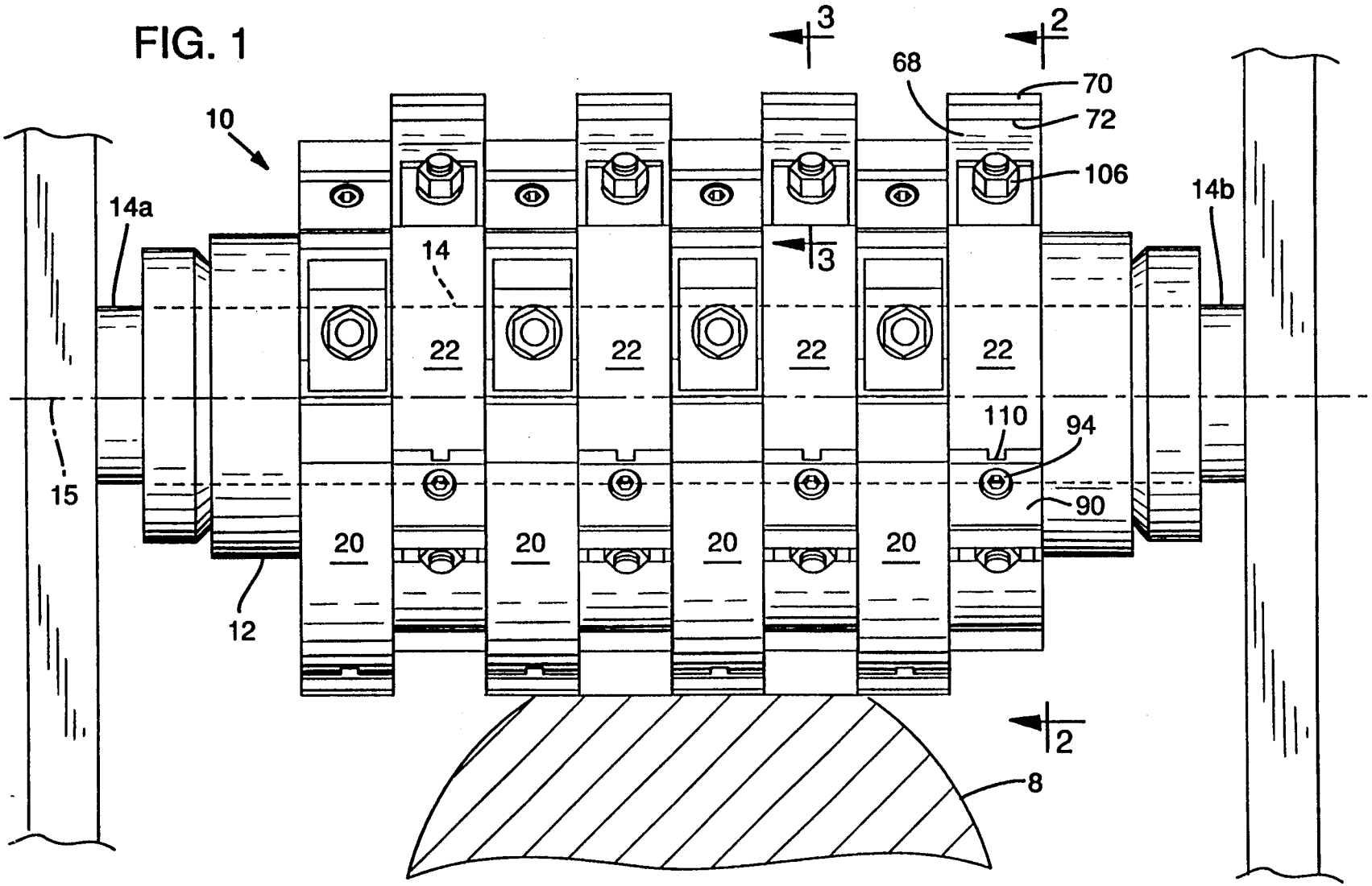
FIG. 1 is a side view of a chipping cutter head constructed according to the present invention.
Figure 2:
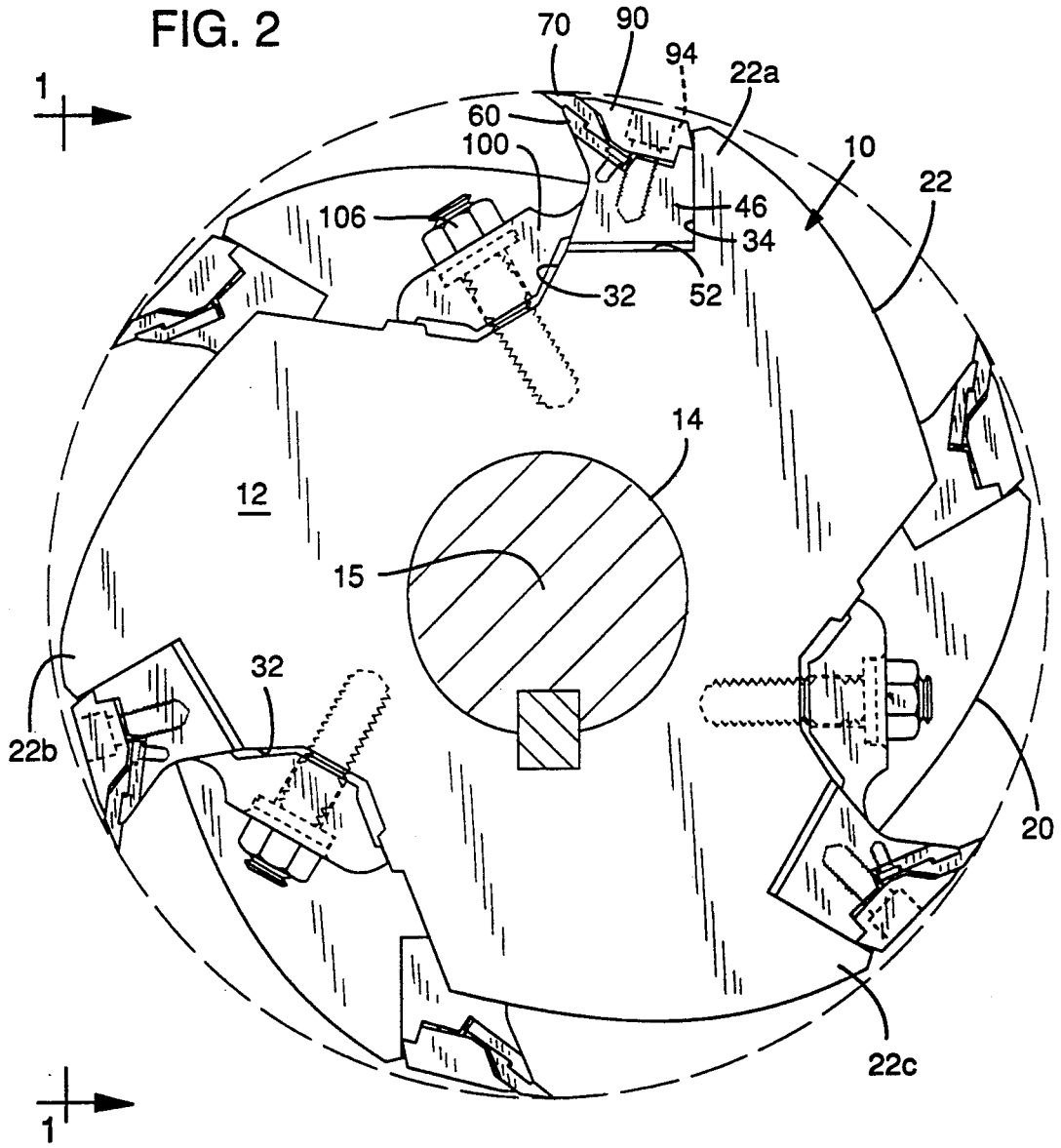
FIG. 2 is a cross-sectional view, taken generally along the line 2—2 in FIG. 1.

Referring initially to FIGS. 1 and 2, a cutter head constructed according to the present invention is indicated generally at 10. The cutter head includes what is referred to herein as a cutter head body 12, and a shaft 14 to which the body is keyed so as to be rotatable with the shaft. The shaft includes what are referred to herein as shaft extensions, shown at 14*a* and 14*b*, that project outwardly from opposite ends of the cutter head body. During use, the cutter head is rotated about axis 15 of shaft 14.

Cutter head body 12 is formed of plural spindle segments 20, interspersed with plural spindle segments 22. The spindle segments are disposed side-by-side on shaft 14. The spindle segments may all have the same construction, so only one will be described in detail.

Specifically, and with reference to a spindle segment 22 (refer to FIG. 2), the segment includes projecting portions 22*a*, 22*b*, and 22*c* equally circumferentially distributed about axis 15 of shaft 14. Separating these projecting portions are indent regions 32, and each indent region includes a pocket 34.

The spindle segments are mounted on the shaft with one series of segments (segments 22) aligned with each other and offset in a circumferential direction from the remainder of the segments (segments 20). With each spindle segment having three projecting portions circumferentially spaced 120° from each other, a circumferential offset of 60° between the segments of one series and the segments of the other series is present. This results in the projecting portions of one series of segments being spaced, in a circumferential direction, midway between the projecting portions of the other series of segments.

Figure 3:
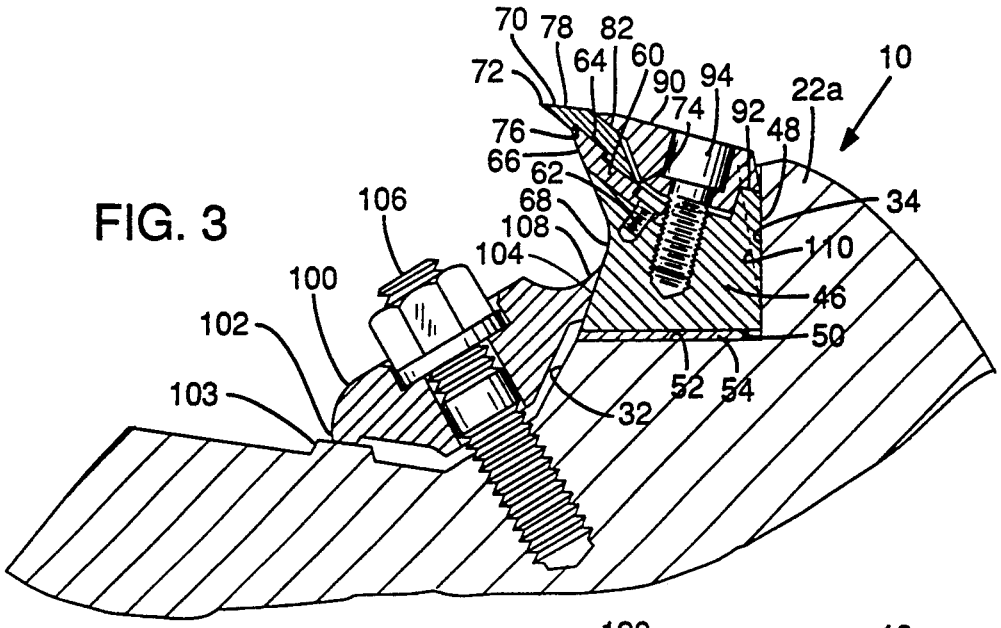
FIG. 3 is a view taken along the line 3—3 in FIG. 1.

Seated within a pocket of each indent region is what is referred to as a knife holder, shown at 46. The knife holder has an upright rear wall 48 (see FIG. 3) which fits against a side wall of the pocket, and a base 50 disposed above the floor 52 of the pocket. Between the base of the holder and the floor, a spacer, such as that shown at 54, may be provided, which is selected to have the holder assume the exact position desired in the pocket. The holder has essentially a side-to-side dimension equalling the width of a spindle segment, so that the side of the holder facing the viewer in FIG. 2 extends approximately in the plane of the face of the spindle segment that is toward the viewer in FIG. 2. The opposite side which is disposed away from the viewer in FIG. 2 extends substantially in the plane of the opposite face of the spindle segment.

Supported on the knife holder is a counter knife 60. The counter knife is secured in place, as with fasteners 62 (see FIG. 3) extending through suitable bores provided in the counter knife and into threaded bores provided in the knife holder. Extending along the top, forward portion of the counter knife is a key portion 64. The lower portion of the counter knife adjacent this key portion is defined by a guiding surface 66.

The knife holder along its forward extremity is bounded by a concave guiding surface 68. Surface 66 meets or is slightly a head of surface 68 in the knife holder.

Cutting is performed by a double-edged knife or knife element shown 70. The knife element is symmetrical in cross section, and has cutting edges 72, 74 extending along the base of the element and on either side of a center keyway 76. A back knife surface, such as surface 78, joins with each cutting edge. Joining the back knife surfaces is a bearing surface 82.

The knife element is supported in the assembly, with key portion 64 within keyway 76, one of the knife elements cutting edges disposed in advance of the counter knife, and the other cutting edge disposed rearwardly of the key portion. When a cutting edge become dull, this may be replaced by turning the knife element on itself, to place the other cutting edge in advance of the counter knife. With both cutting edges dulled, a replacement knife element is easily mounted in place. With a knife element being precision made, it should be apparent that with replacing of a cutting edge, there is no requirement that the knife holder be repositioned within the pocket receiving it.

Securing a knife element in place on the counter knife is a knife clamp 90. A rear portion of the knife clamp fits over ledge 92 in the knife holder, and a forward portion of the knife clamp bears against bearing surface 82 in the knife element. Securing the knife clamp on the knife holder is a fastener 94.

A knife holder clamp is shown at 100. Extending along one edge of this clamp is a shoulder 102 bearing against a rib 103 in the spindle segment. Opposite this shoulder is a pad portion 104 which bears against guiding surface 68 of the knife mounting. A fastener 106 secures the knife holder clamp in proper position adjacent the base of an indent region of the spindle segment.

The knife holder clamp includes a guiding surface 108 and this guiding surface smoothly meets with guiding surface 68. Guiding surface 108 forms a concave continuation of guiding surface 68, and these guiding surfaces together define a ramp which cut material travels over on being expelled from the cutter head and after being cut by the knife element.

In the embodiment of the apparatus shown, each spindle segment mounts three knives having a construction as just described. In the assembled cutter head, knives in alternate spindle segments are aligned with each other, and knives in one row are 60° to the rear of knives in a preceding row and 60° in advance of knives in a following row. With rotation of the cutter head, all the knives move in circular paths with the cutting edge of each knife moving in a circular path which has the same radius and extends about the same axis as the paths of the edges of the other knives.

The back of holder 46 and knife clamp 90 may be grooved or notched to receive a rib 110 presented by the spindle segment. This construction locks the holder from movement in the direction of axis 15.

In producing a cant from a log, a log, such as the one shown at 8 in FIG. 1, is moved across the periphery of the cutter head in a direction extending transversely of the rotation axis of the cutter head, to have material cut from the log by the cutting edges of the various knives, and to produce a flat side in the log. In producing the type of cut described, it is obvious that the cutting edges of the various knives have to be precisely positioned, if the cut is to be optimal. With the organization described, in the replacing of a cutting edge, the knife holder need not be moved. Instead, the knife element is either replaced or turned on itself to place a new edge in operative position. This is a relatively easy operation for maintenance personnel to perform, in comparison to preparing a new edge through grinding, with this being followed with a babbitting operation to place the newly sharpened edge at a proper position.

Figure 4:
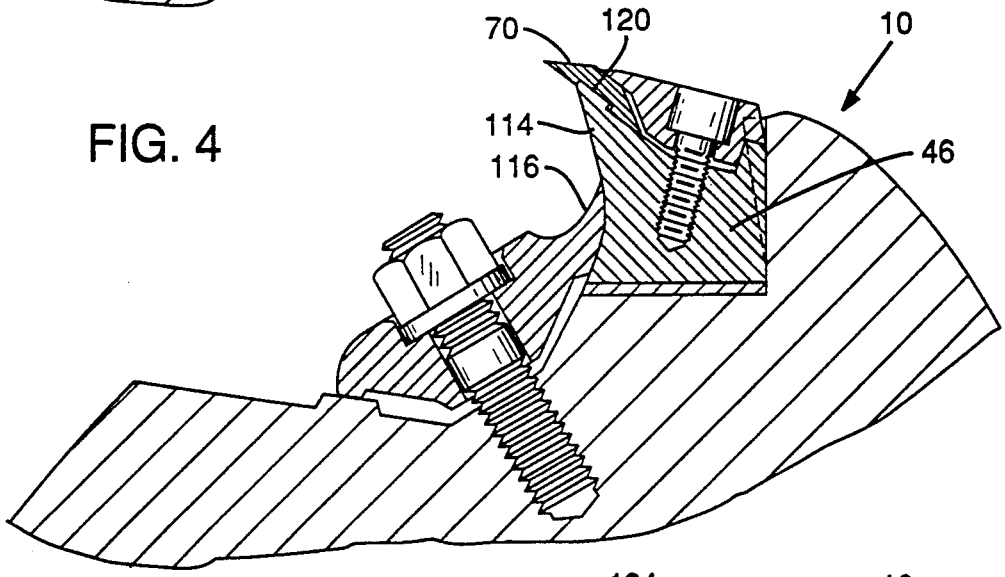
FIGS. 4, 5, and 6 are similar to FIG. 3, but showing modifications of the invention.

In the modification of the invention shown in FIG. 4, guiding surfaces 114, 116 in the knife holder and the knife clamp, respectively, have a different curvature than guiding surfaces 68, 108 earlier described, and cooperatively define a ramp with a different guide path than that provided by surfaces 68, 108. Variations in the guiding surfaces and the ramp that they define are possible, with these variations producing a different chip thickness and size of chip with the various wood species being chipped with the cutter head.

It will also be noted in the modification shown in FIG. 4 that knife holder 46 directly supports knife element 70, with key portion 120 being an integral part of the knife holder.

Figure 5:
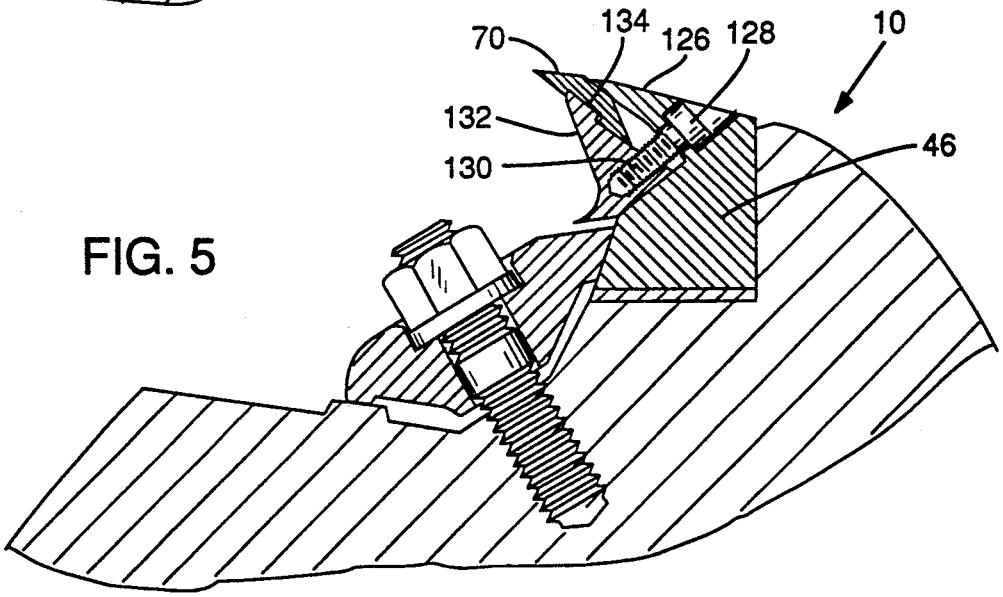

In FIG. 5, a further modification of the invention is illustrated. In this modification, knife holder 46 includes an expanse 126 which overlies knife element 70. Fastener 128 extends through a smooth bore provided in expanse 126 and has its threaded end received within an internally threaded bore 130 of a clamp element 132. Clamp element 132 includes key portion 134. With tightening of fastener 128, clamp element 132 is drawn up against the underside of the knife element to securely clamp it against the underside of expanse 126.

Figure 6:
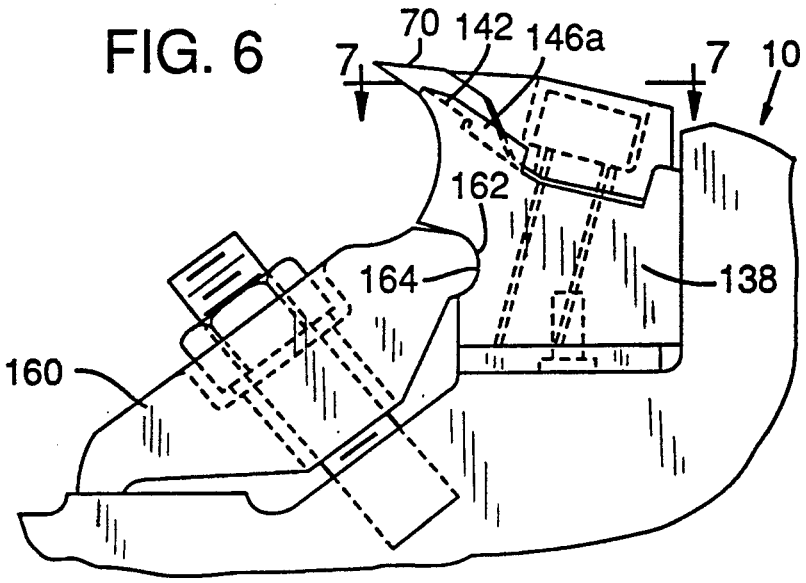
Figure 7:
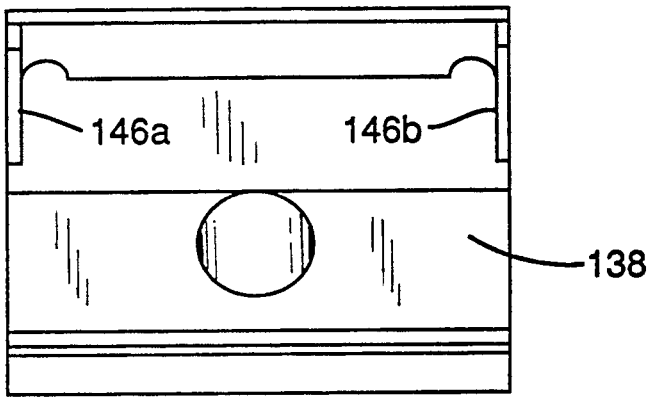
FIG. 7 is a view taken generally along the line 7-7 in FIG. 6.

In the modification of the invention shown in FIGS. 6 and 7, knife holder 138 has a key portion 142 which fits within the keyway of knife element 70. The knife holder further includes stop flanges extending outwardly from adjacent opposite sides of the holder. Knife element 70, when mounted in place with its keyway receiving key portion 142, has its ends located inwardly of flanges **146*a*, 146*b***. The flanges prevent movement of the knife element in a direction of its axis, or in a direction paralleling its cutting edges. They also function as dust covers, preventing dust and debris from working between the knife element and the knife holder.

It will also be noted in the modification shown in FIGS. 6 and 7 that knife holder clamp 160 has a rib 162, and this rib sits within a groove 164 extending along knife holder 138. The construction provides more aggressive clamping of the knife holder in the pocket receiving it by the knife holder clamp.

Figure 8:
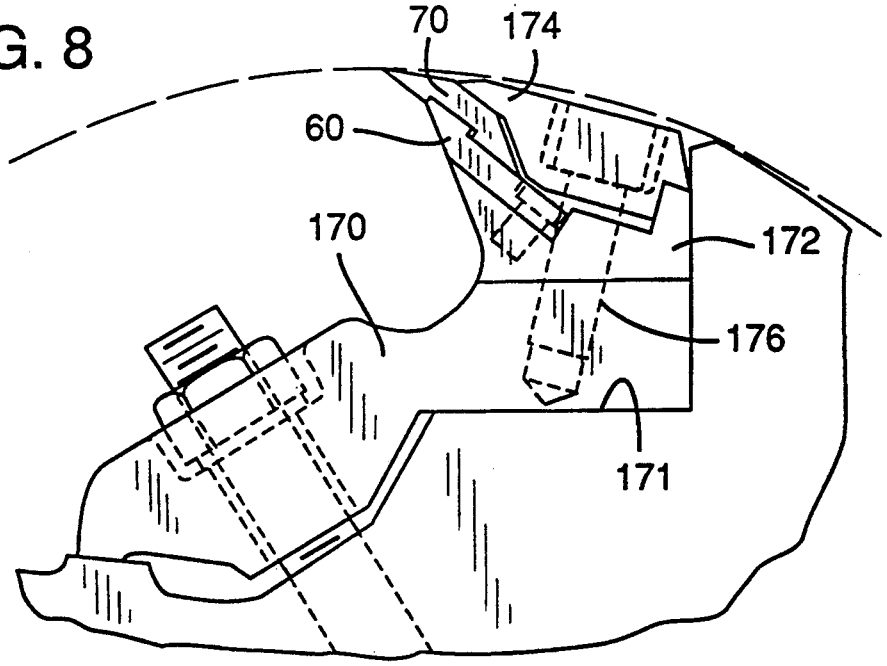
FIG. 8 is similar to FIG. 6, but illustrated yet another modification of the invention.

In the modification shown in FIG. 8, clamp 170 clamps directly against a surface 171 of the spindle segment. Knife holder 172 rests on clamp 170. Counter knife 60 is mounted on the knife holder and a knife element 70 is supported on the counter knife. A knife clamp 174 clamps the knife element against the counter knife. A fastener 176 extends through the knife holder and is fastened into clamp 170. The fastener holds the knife holder against clamp 170 and also holds knife clamp 174 tightly against the back of the knife element.

While various forms of the invention have been illustrated, and it should be obvious that other variations and modifications are possible without departing from the invention as defined by the claims which follow in this specification.

It is claimed and desired to secure by Letters Patent:

1. In a chipping cutter head that includes a shaft, spindle segments mounted on and spaced axially on the shaft, and multiple knife elements mounted on the spindle segments and rotatable in circular paths about the axis of said shaft with rotation of the cutter head, a first knife element on one spindle segment producing an approximately cylindrical cut with rotation of the cutter head and a second knife element on another spindle segment producing an approximately cylindrical cut with rotation of the cutter head, the cylindrical cut of the second element being an approximate continuation in an axial direction of the cylindrical cut produced by the first element, each knife element having a pair of cutting edges forming opposite edge extremities of the knife element and opposed sides bounding the knife element between the cutting edges of the element, a mounting for each knife element on its respective spindle segment comprising a pocket in the spindle segment and the pocket having a floor, a knife holder received in the pocket, the knife holder having an established desired position supported by the floor of the pocket, the knife element being supported on the knife holder, releasable holder-securing means securing the knife holder to the spindle segment and releasable knife-securing means securing the knife element to the knife holder, the knife-securing means comprising an adjustable clamp clamping against a side of the knife element and the clamp being releasable to enable removal of the knife element.

2. The chipper cutter head of claim 1, which includes interfitting complementing rib and groove portions interposed between the knife holder and spindle segment, said rib and groove portions inhibiting displacement of the knife holder in a direction extending axially of the spindle segment.

3. The chipping cutter head of claim 1, wherein the knife holder clamp has a chip-guiding surface, and wherein the knife holder has a complementing chip-guiding surface, the chip-guiding surface of the knife holder clamp forming a concave extension of the chip-guiding surface of the holder and the chip-guiding surfaces collectively providing a concave ramp for material cut by the knife element.

4. The chipping cutter head of claim 1, wherein the holder-securing means comprises a knife holder clamp, and the knife holder clamp has a chip-guiding surface, and wherein the knife holder has a complementing chip-guiding surface, the chip-guiding surface of the knife holder clamp forming a concave extension of the chip-guiding surface of the holder and the chip-guiding surfaces collectively providing a concave ramp for material cut by the knife element.

5. A chipping cutter head including a body portion and shaft extensions extending from opposite ends of the body portion, the extensions having a common axis and said extensions providing for rotation of the cutter head about said axis, at least one pocket defined in said body portion adjacent the periphery thereof, a knife holder mounted in said pocket, a knife element mounted on said knife holder, the knife element being supported by the holder at the periphery of said body portion and the knife element moving in a circular path about said axis with rotation of the cutter head, knife clamp means mounting said knife element on said knife holder, and knife holder clamp means mounting said holder on said body portion, said knife element having pair of cutting edges forming opposite edge extremities of the knife element and opposed sides bounding the knife element between the cutting edges of the knife element, said knife clamp means comprising an adjustable clamp clamping against a side of the knife element and the clamp being releasable to enable removal of the knife element.

6. The chipping cutter head of claim 5, which further includes a keyway presented by the knife element and a key presented by the knife holder and the keyway and key keying the knife element on the knife holder to prevent lateral displacement and which further comprises additional structure interposed between the knife holder and knife element positively locking the knife element from displacement in the direction of its axis relative to the knife holder.

7. A chipping cutter head including a body portion and shaft extensions extending from opposite ends of the body portion, the extensions having a common axis and said extensions providing for rotation of the cutter head about said axis, a least one pocket defined in said body portion adjacent the periphery thereof, a knife holder mounted in said pocket, an elongate knife element mounted on said knife holder, the knife element being supported by the holder at the periphery of said body portion and the knife element moving in a circular path about said axis with rotation of the cutter head, knife clamp means mounting said knife element on said knife holder and knife holder clamp means mounting said holder on said body portion, and structure interposed between the knife holder and knife element locking the knife element from displacement in the direction of its axis relative to the knife holder.

8. The cutter head of claim 7, wherein said structure locking the knife element comprises shoulders engaging opposite ends of the knife element.

* * * * *